US007303345B2

(12) United States Patent
Bedzyk et al.

(10) Patent No.: US 7,303,345 B2
(45) Date of Patent: Dec. 4, 2007

(54) PINION ROLLER DRIVE FOR RECORDING APPARATUS

(75) Inventors: Mark D. Bedzyk, Pittsford, NY (US); Jeffery R. Hawver, Marion, NY (US)

(73) Assignee: Carestream Health, Inc., Rochester, NY (US)

( * ) Notice: Subject to any disclaimer, the term of this patent is extended or adjusted under 35 U.S.C. 154(b) by 284 days.

(21) Appl. No.: 11/035,307

(22) Filed: Jan. 13, 2005

(65) Prior Publication Data

US 2006/0153622 A1 Jul. 13, 2006

(51) Int. Cl.
*B41J 13/03* (2006.01)
*B41J 2/01* (2006.01)

(52) U.S. Cl. ..... 400/625; 400/624; 400/636; 347/104

(58) Field of Classification Search ..... 400/624, 400/625, 629, 636, 637, 639; 347/104, 262, 347/264, 218
See application file for complete search history.

(56) References Cited

U.S. PATENT DOCUMENTS 5,392,839 A 2/1995 Yukumoto et al. ..... 160/348
5,506,606 A * 4/1996 Saikawa et al. ..... 346/134
5,573,337 A * 11/1996 Yasuoka ..... 400/605
6,027,211 A * 2/2000 Unosawa et al. ..... 347/104
6,135,025 A 10/2000 Zimmer ..... 101/129
2003/0030712 A1* 2/2003 Kawaguchi et al. ..... 347/104

FOREIGN PATENT DOCUMENTS

JP 06199444 A * 7/1994

* cited by examiner

*Primary Examiner*—Leslie J Evanisko

(57) ABSTRACT

An apparatus for recording an image onto a sheet medium (12) has an entrance drive roller (16) paired with a corresponding entrance pressure roller (18) to form an entrance nip (14) for transporting the sheet medium into an image recording section (20). The image recording section has a write head (56) for recording onto a portion of the sheet medium being transported between the entrance nip (14) and exit nip (24). The exit nip is formed by a drive roller (26) paired with a corresponding exit pressure roller (28) for transporting the sheet medium out from the image recording section. A motor (60) provides rotary motion to a pinion roller (40) mechanically coupled to the entrance and exit drive rollers (16, 26). A loading mechanism provides a loading force to nest the pinion roller into rotational contact against a portion of the entrance and exit drive rollers (16, 26).

15 Claims, 15 Drawing Sheets

PINION ROLLER DRIVE FOR RECORDING APPARATUS

CROSS REFERENCE TO RELATED APPLICATIONS

Reference is made to commonly-assigned copending U.S. patent application Ser. No. 10/977,841, filed Oct. 29, 2004, entitled SHEET RECORDING APPARATUS WITH DUAL NIP TRANSPORT by Hawver et al., the disclosure of which is incorporated herein.

FIELD OF THE INVENTION

This invention generally relates to sheet media transport apparatus and more particularly relates to an image recording apparatus with a precision media transport apparatus that uses a dual nip system having precision drive roller motion provided by a pinion drive.

BACKGROUND OF THE INVENTION

Nip-fed sheet media transport systems using paired rollers are widely used in various printing applications. In a nip-fed system, a drive roller is pressed against a backing roller to form a nip and provides drive motion at the nip. A nip-fed transport can be engineered to perform with a suitable degree of accuracy in devices such as printers and office copiers. However, conventional nip-fed media transport mechanisms do not provide sufficient precision for imaging applications that require high resolution. For example, many types of medical imaging apparatus print onto a sheet of recording medium at resolutions well exceeding 600 dots per inch. For such devices, a sheet media transport must provide extremely accurate motion when moving the sheet through the image recording mechanism. This problem becomes even more pronounced with full-sheet imaging, in which little or no margin is to be provided at the leading or trailing edges of a sheet. As is well appreciated by those skilled in media transport arts, the dynamics of handling and urging a sheet of recording medium through a printing mechanism can be much more complex at the leading and trailing edges than along more central portions of the sheet.

Dual nip apparatus provide advantages where it is necessary to provide more precise motion control for sheet media. By using two pairs of rollers in series along the transport path, a more stable sheet media transport is provided, since the motion of the medium is controlled through at least one nip at any point during the image recording process. FIG. 1 shows, in schematic form, a conventional dual nip transport apparatus 10 as used for a sheet of recording medium 12. In the travel path, recording medium 12 is fed through an entrance nip 14 formed between an entrance drive roller 16 and a pressure roller 18, then through an exit nip 24 formed between an exit drive roller 26 and a pressure roller 28. Image data is recorded by a printhead 56 onto recording medium 12 in an imaging area 20 between entrance nip 14 and exit nip 24, typically using a laser or other source of electromagnetic radiation. In order to provide uniform speed with dual nip media transport apparatus 10, it is necessary to couple the speed of entrance drive roller 16 at entrance nip 14 with the speed of exit drive roller 26 at exit nip 24. The conventional method for coupling entrance and exit drive rollers 16 and 26 is using a belt 22, as shown in FIG. 1.

While the use of belt 22 for synchronizing entrance and exit drive rollers 16 and 26 works well in many applications, the precision afforded by this arrangement falls short of what is needed for high resolution imaging. Problems such as disturbance of uniform velocity or flutter cause variation in the transport velocity of recording medium 12, particularly during leading-edge and trailing-edge handling intervals in which recording medium 12 is gripped only at entrance nip 14 or exit nip 16. Other problems related to compliance and tracking render the use of belt 22 as an unsatisfactory solution, particularly for media such as film that is generally thicker and more rigid than paper media or for sheet media that can vary in thickness. Furthermore, belt 22 is a wear item that may require replacement and whose performance can be degraded by age, usage, and dust or dirt.

There are a number of alternatives for providing rotational motion to entrance and exit drive mechanisms. As one alternative, either entrance drive roller 16 or exit drive roller 26 could be directly coupled to a motor shaft, with coupling mechanisms provided between these rollers. However, due to inherent coupling losses and mechanical tolerances, it can be difficult to obtain a coupling arrangement that provides highly efficient coupling with minimum flutter. As another alternative, a third roller can be driven by the motor and used to couple rotation to entrance and exit rollers. While this option offers some advantages, its implementation is complicated by the need to maintain efficient coupling under load and to compensate for unwanted mechanical effects caused by motor rotation.

Thus, it can be seen that there is a need for a transport mechanism that provides precision handling of single sheet media at a constant transport speed, allowing full sheet imaging from leading to trailing edge.

SUMMARY OF THE INVENTION

It is an object of the present invention to provide a sheet media transport apparatus capable of improved precision. With this object in mind, the present invention provides an apparatus for recording an image onto a sheet medium, comprising:

a) an entrance drive roller paired with a corresponding entrance pressure roller to form an entrance nip for transporting the sheet medium into an image recording section;

b) an image recording section comprising a write head for recording onto a portion of the sheet medium being transported between the entrance nip and an exit nip;

c) an exit nip formed by a drive roller paired with a corresponding exit pressure roller, for transporting the sheet medium out from the image recording section;

d) a motor for providing rotary motion to a pinion roller, the pinion roller mechanically coupled to the entrance and exit drive rollers; and e) a loading mechanism providing a loading force to nest the pinion roller into rotational contact against a portion of the entrance and exit drive rollers.

It is a feature of the present invention that it employs a coupling roller to transfer rotational energy to both driver rollers. Unlike prior art arrangements, the coupling roller does not form a nip or directly transport the medium, but is used to provide continuous, smooth motion between the entrance and exit drive rollers, each of which forms its corresponding nip with a separate pressure roller.

It is an advantage of the present invention that it provides a sheet media transport solution with higher mechanical coupling stiffness than is conventionally available using belt devices. This increased coupling stiffness, in turn, improves mechanical resonance characteristics of the media transport apparatus of the present invention. The apparatus and method of the present invention minimize the need for replaceable components and provide a self-aligning coupling, minimizing the need for synchronization adjustment to the sheet transport apparatus.

It is an advantage of the present invention that it provides improved velocity uniformity, with a design that inherently averages surface noise from system components.

These and other objects, features, and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

While the specification concludes with claims particularly pointing out and distinctly claiming the subject matter of the present invention, it is believed that the invention will be better understood from the following description when taken in conjunction with the accompanying drawings, wherein:

DETAILED DESCRIPTION OF THE INVENTION

The present description is directed in particular to elements forming part of, or cooperating more directly with, apparatus in accordance with the invention. It is to be understood that elements not specifically shown or described may take various forms well known to those skilled in the art.

Figure 1:
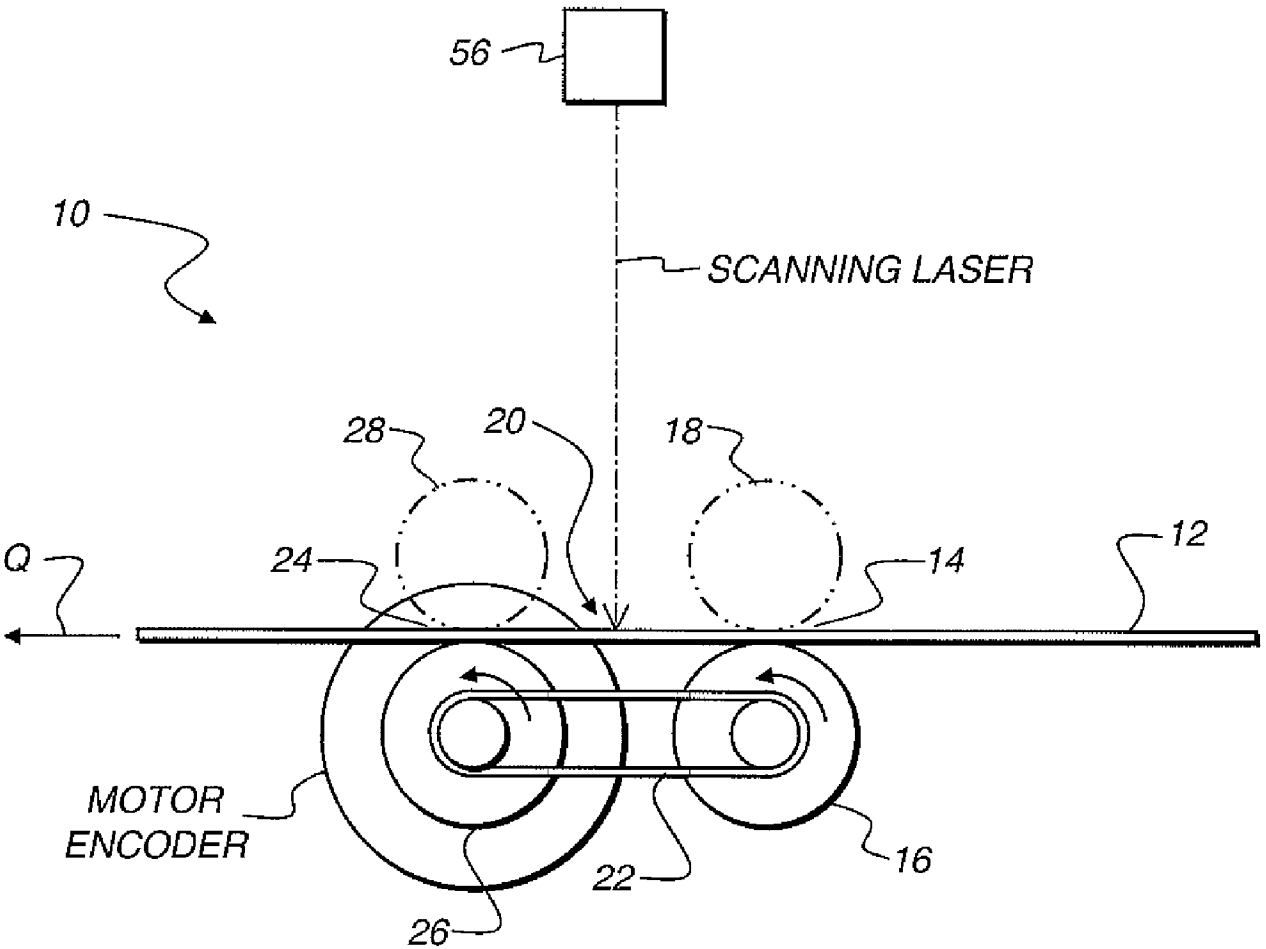
FIG. 1 PRIOR ART
FIG. 1 is a schematic diagram showing a conventional, prior art, dual-nip media transport apparatus.
Figure 2:
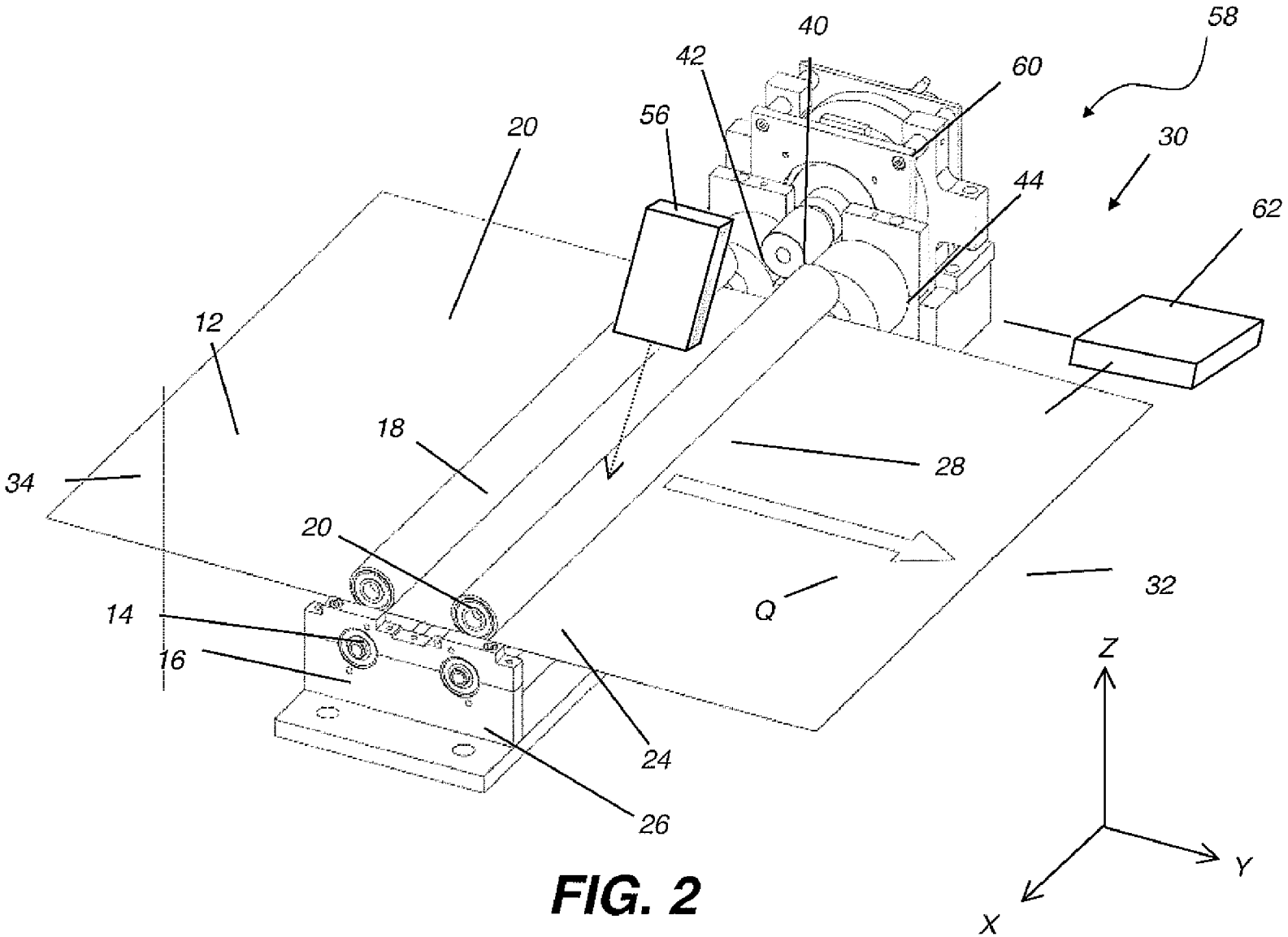
FIG. 2 is a perspective view of an apparatus for image recording, using a dual-nip media transport according to the present invention.

Referring to FIG. 2, there is shown an image recording apparatus 58 for full sheet imaging, utilizing a dual nip media transport apparatus 30 according to an embodiment of the present invention. A sheet of recording medium 12, transported in direction Q, has a leading edge 32 and a trailing edge 34. Pressure rollers 18 and 28 cooperate with corresponding entrance and exit drive rollers 16 and 26 to form entrance nip 14 and exit nip 24, respectively. In the embodiment shown, a motor 60 provides rotational energy to a pinion roller 40. Pinion roller 40 couples rotation to both entrance and exit drive rollers 16 and 26 at speed reduction wheels 42 and 44. For reference, conventional Cartesian coordinate x, y, z axes are as shown in FIG. 2, with direction Q in parallel with the y axis and rollers extended in the direction of the x axis.

Imaging area 20 is in a widthwise strip of recording medium 12 between entrance and exit nips 14 and 24. Printhead 56 directs exposure energy from a laser or other source, in a scanned fashion, onto that portion of recording medium 12 that is within imaging area 20. A control logic processor 62 controls the flow of image data to printhead 56, controls operation of motor 60, which may be provided with an encoder, and controls other internal and interface functions of image recording apparatus, using components, algorithms, and techniques familiar to those skilled in the electronic imaging arts.

Figure 3:
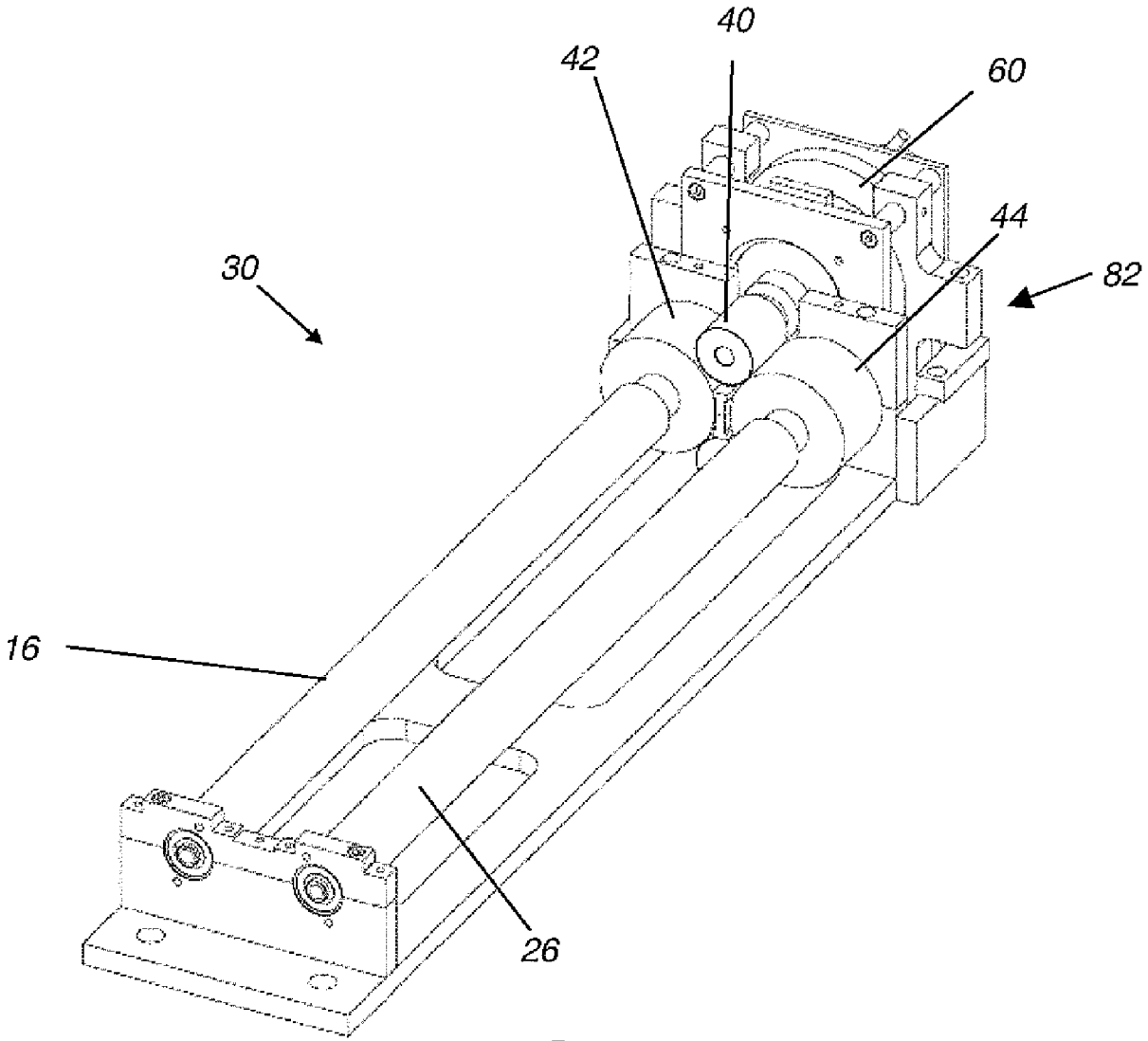
FIG. 3 is a perspective view showing the dual nip transport apparatus of the present invention.

Referring to FIG. 3, there is shown a portion of dual nip transport apparatus 30 without recording medium 12 or pressure rollers 18, 28. This provides a clearer view of pinion roller 40 and the support mechanisms for driving entrance and exit drive rollers 16 and 26. Speed reduction wheels 42, 44 are in continuous rotational contact with pinion roller 40. The use of speed reduction wheels 42 enables motor 60 to operate more efficiently, running at a higher rotational speed.

Mounting Arrangement for Motor 60

Still referring to FIG. 3, a motor pinion assembly 82 is designed to provide a number of functions in dual nip transport apparatus 30. Pinion roller 40 must be maintained in continuous rotational contact against speed reduction wheels 42, 44. Force is required to nest pinion roller 40 in position against speed reduction wheels 42, 44. At the same time, components of motor pinion assembly 82 must counter the rotational torque of motor 60.

Figure 4A:
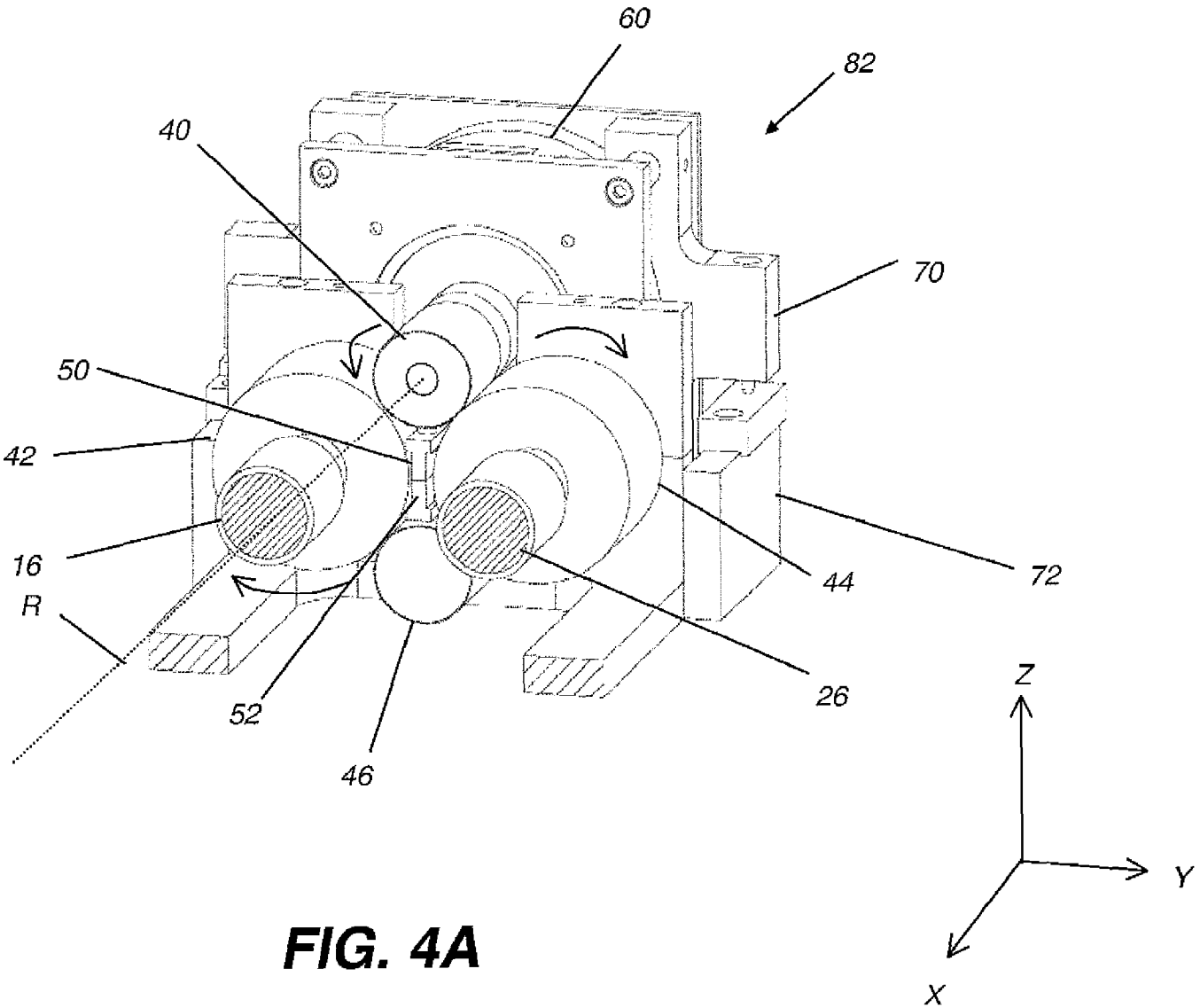
FIGS. 4A and 4B are perspective and partially exploded views, respectively, of drive components of the dual nip media transport.
Figure 4B:
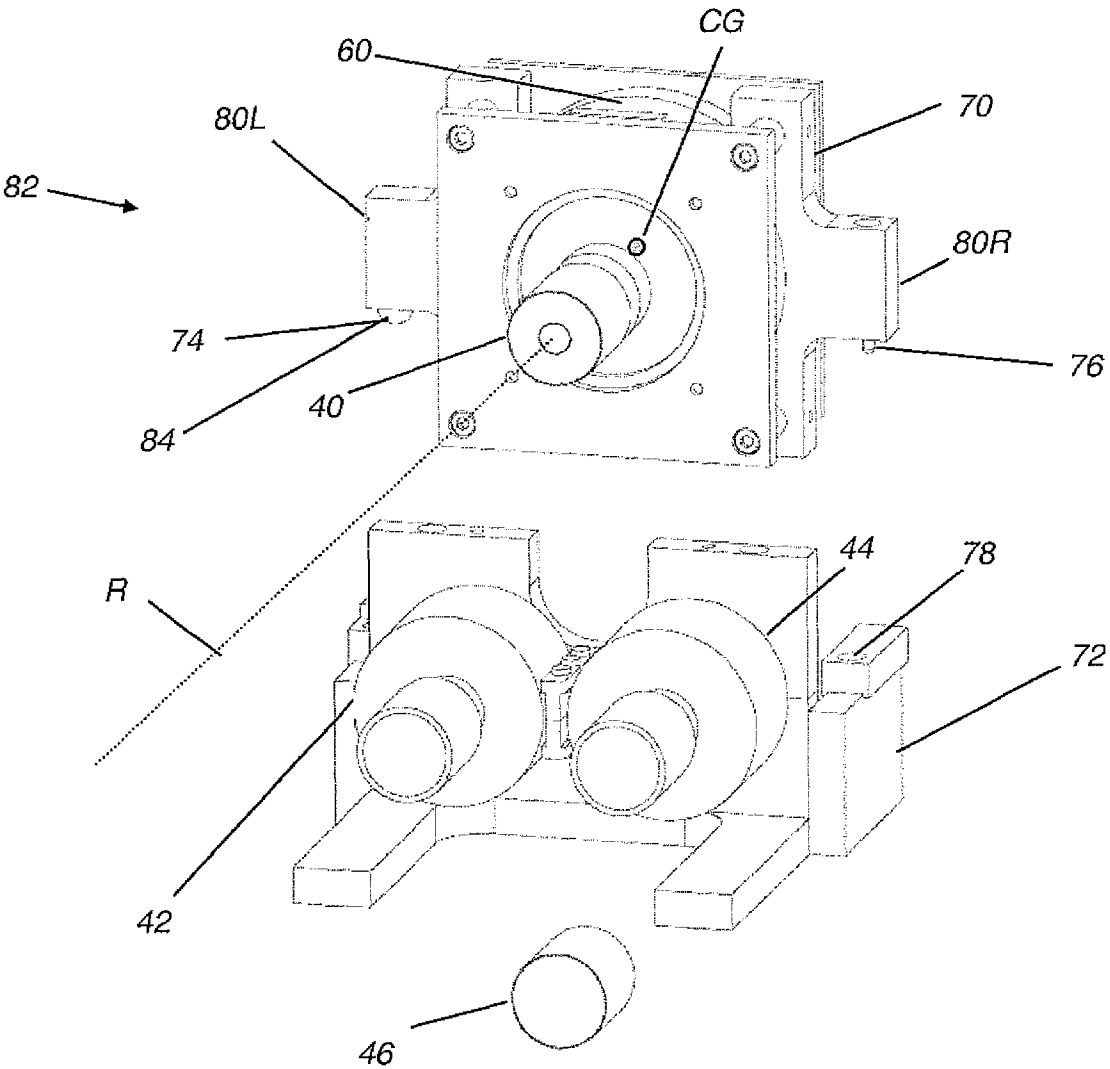

Referring to FIG. 4A, there is shown a cutaway perspective view of the drive portion of dual nip transport apparatus 30 and motor pinion assembly 82. An optional counter roller 46 may also be provided, for reasons described subsequently. FIG. 4B shows a partially exploded view of the components shown in FIG. 4A. Motor 60 is mounted in a mounting bracket 70 that serves as a motor body mount. Mounting bracket 70 has extended portions: a left and right arm 80L and 80R extending in directions away from rotational axis R. Mounting bracket 70 fits onto a base 72 at two seats 78 and is configured to counter the rotational torque of motor 60 and to provide a substantially balanced support for the mass of motor 60. A constraining member 84, spherically shaped in the embodiment shown, provides one seat along left arm 80L. A spring 76 provides a counter force providing element at the second seat along right arm 80R. This counter force effectively balances the weight of motor 60 in its mounting bracket 70. In the embodiment shown, spherical constraining member 84 provides a contact surface 74 as the interface between bracket 70 and base 72. Constraining member 84 is captive in left arm 80L of mounting bracket 70 in the embodiment described here; however, an equivalent component could be captive or supported within base 72 or formed as a machined or molded portion of mounting bracket 70, for example.

Figure 5:
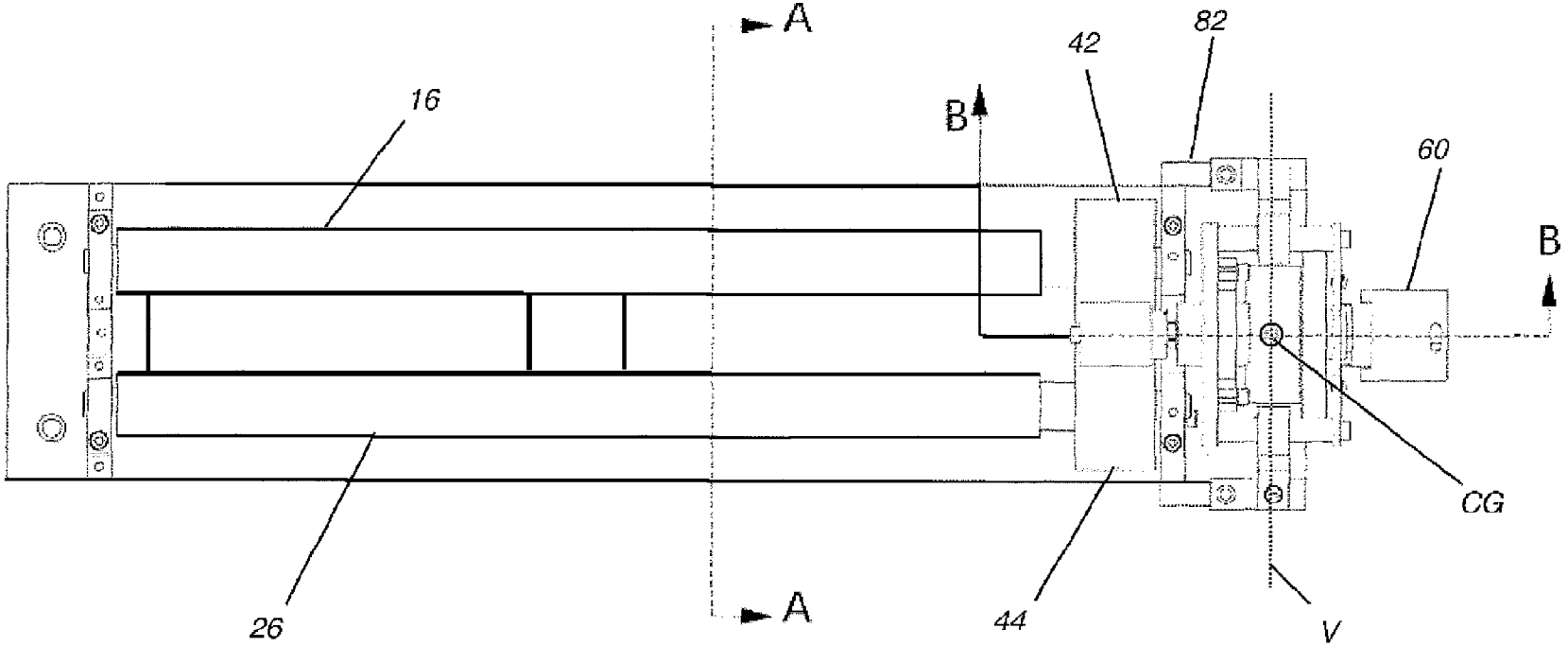
FIG. 5 is a top view showing the dual nip media transport.
Figure 6:
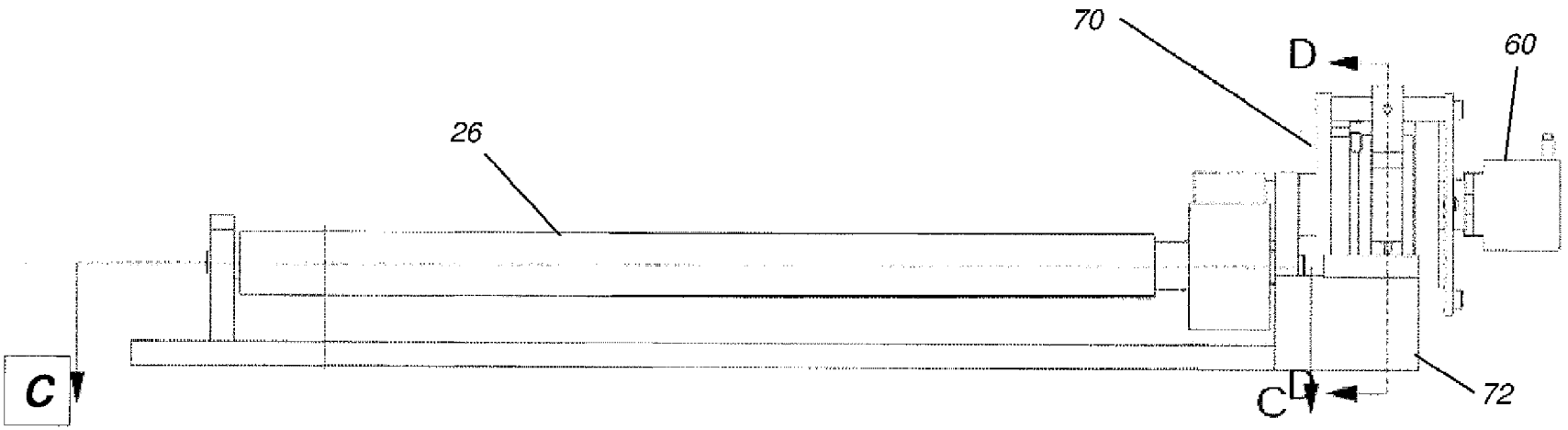
FIG. 6 is a side view showing the dual nip media transport.

A better understanding of the design and function of motor pinion assembly 82 in one embodiment is given by the reference top and side views, respectively, of FIGS. 5 and 6 and the corresponding sectional views of FIGS. 7, 8, 9, and 10 taken from various perspectives with reference to FIGS. 5 and 6. In order to counteract the torsional force exerted by motor 60, motor pinion assembly 82 advantageously maintains a symmetric relationship with the center of gravity, CG, of motor pinion assembly 82. In one embodiment, the approximate center of gravity CG of motor pinion assembly 82, shown most clearly in FIGS. 4B, 5, 8, and 11, is in a substantially common plane, shown as a vertical plane, with the points of contact at constraining member 84 and at spring 76. Common plane V containing these points is shown in the top view of FIG. 5 and in the side view of FIG. 11. Common plane V is orthogonal to the axis of rotation R of motor 60. This arrangement is advantaged for achieving the balanced weight condition just described.

Figure 10:
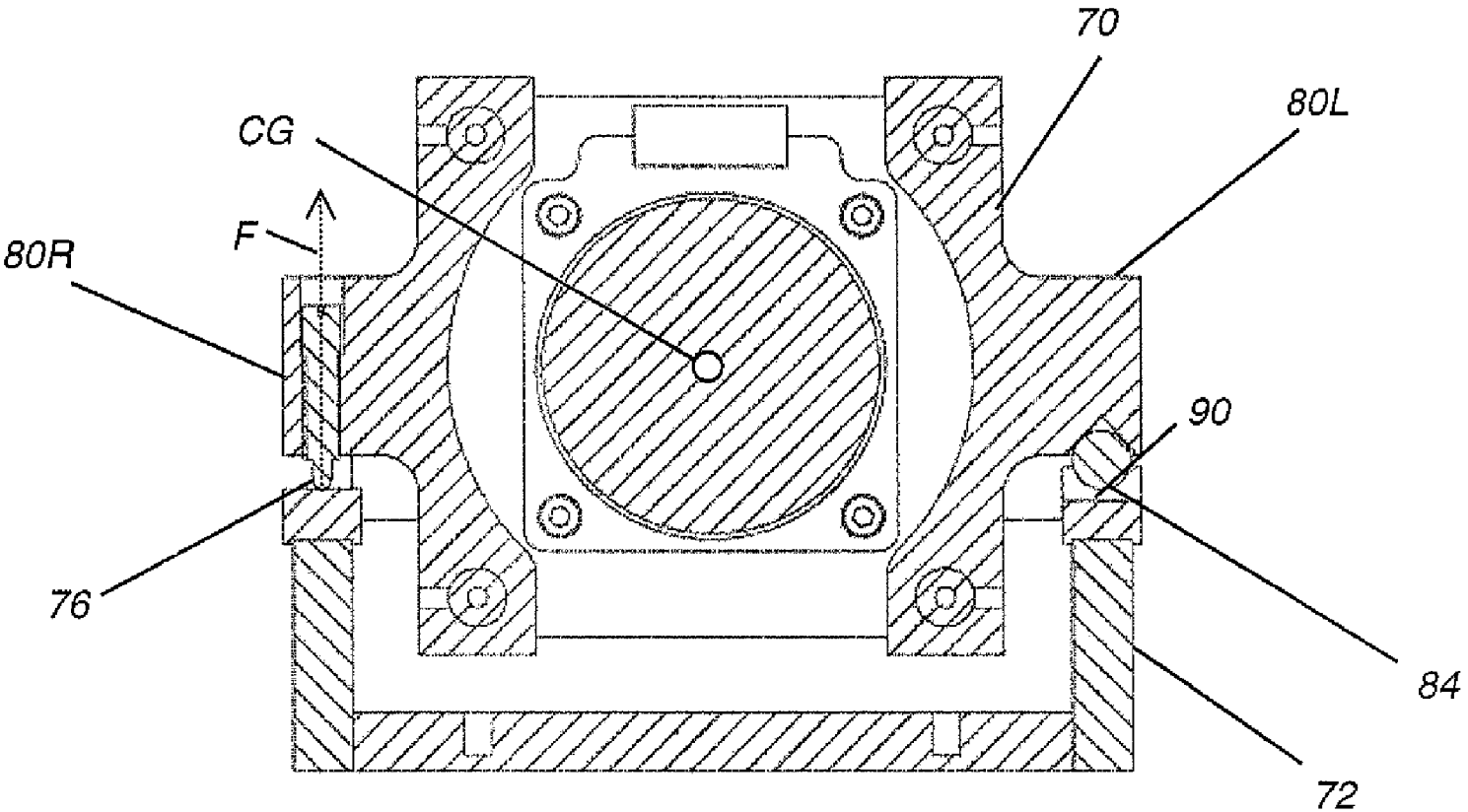
FIG. 10 is a cutaway end view showing drive components of the dual nip media transport.
Figure 11:
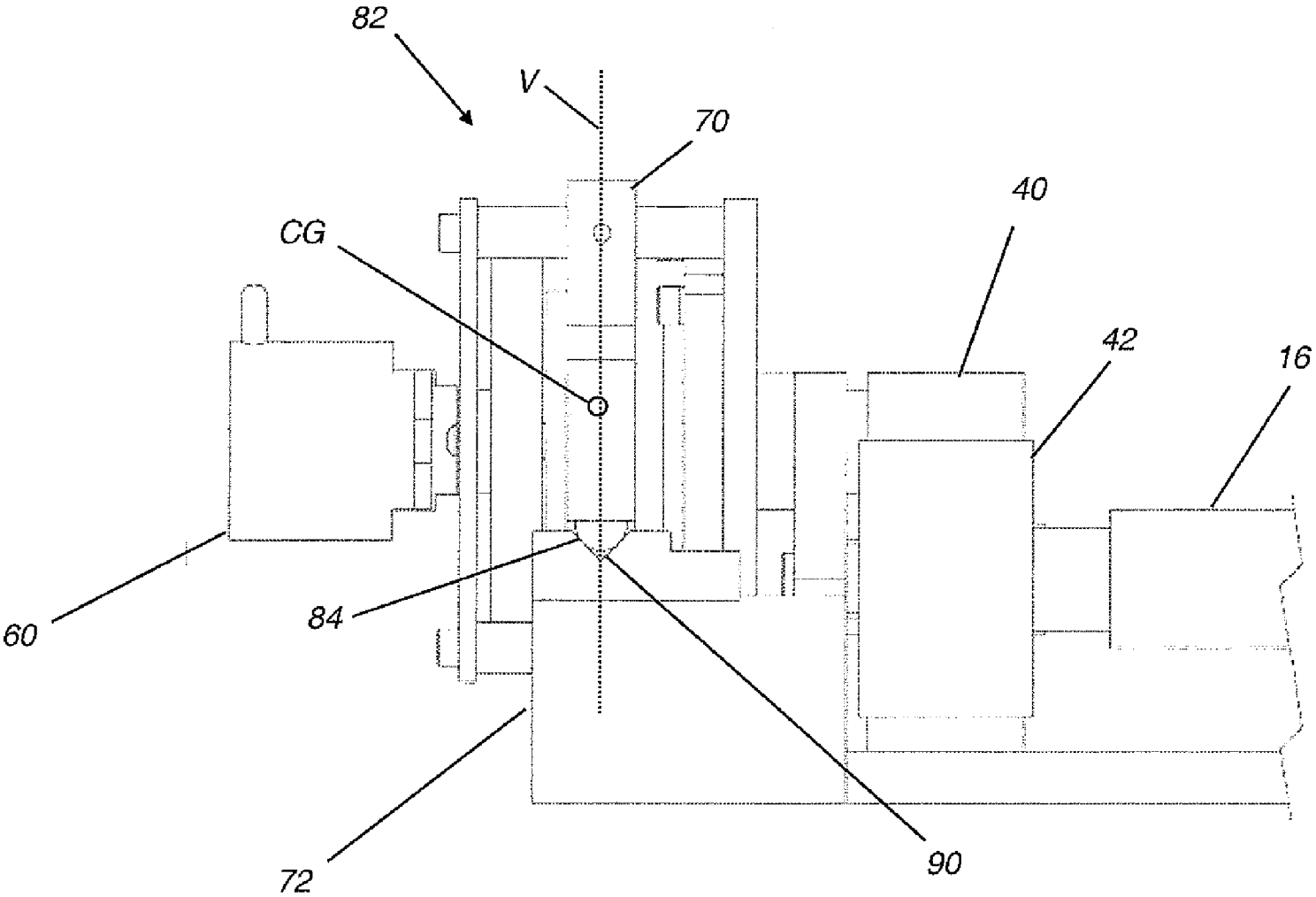
FIG. 11 is a side view of drive mounting components for the dual nip media transport.

As is best shown in the sectional view of FIG. 10, spring 76 applies a force F that opposes the weight of motor pinion assembly 82 at base 72. Constraining member 84 can be captive in either mounting bracket 70 or base 72. A Vee fitting 90, shown in FIGS. 10 and 11, provides a seat that restricts constraining member 84 from movement in both the x-direction, that is, parallel to the axis of rotation R and in the upward or z-direction (FIG. 4A). This, in turn, constrains unwanted forward, backward, and vertical movement of motor 60.

Figure 12:
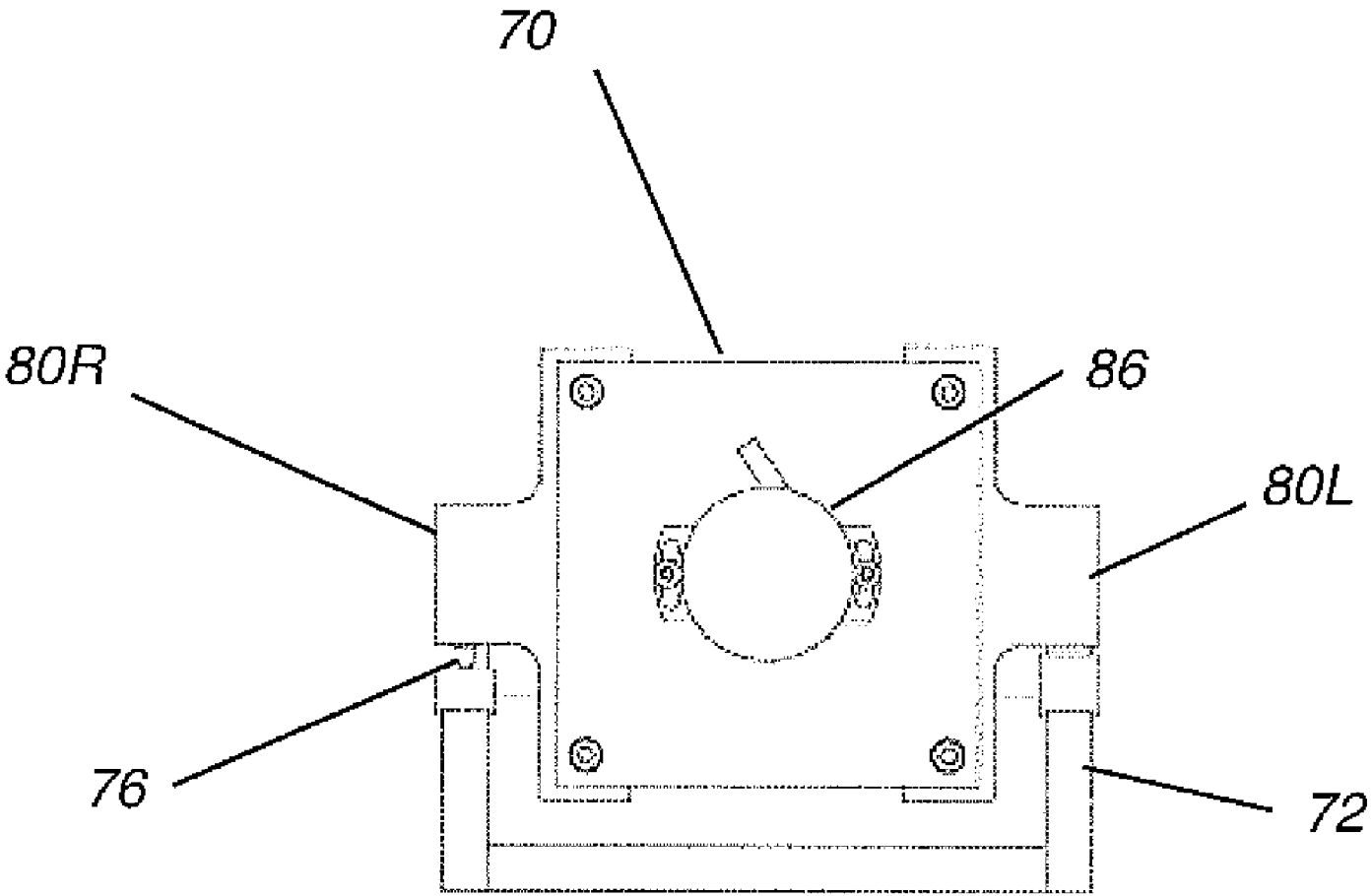
FIG. 12 is a rear view of motor pinion assembly components.

As is shown in FIG. 12, an encoder 86 may be mounted on mounting bracket 70 for providing feedback signals on motor speed and position.

Applying Force to Nest Pinion Roller 40

Figure 13B:
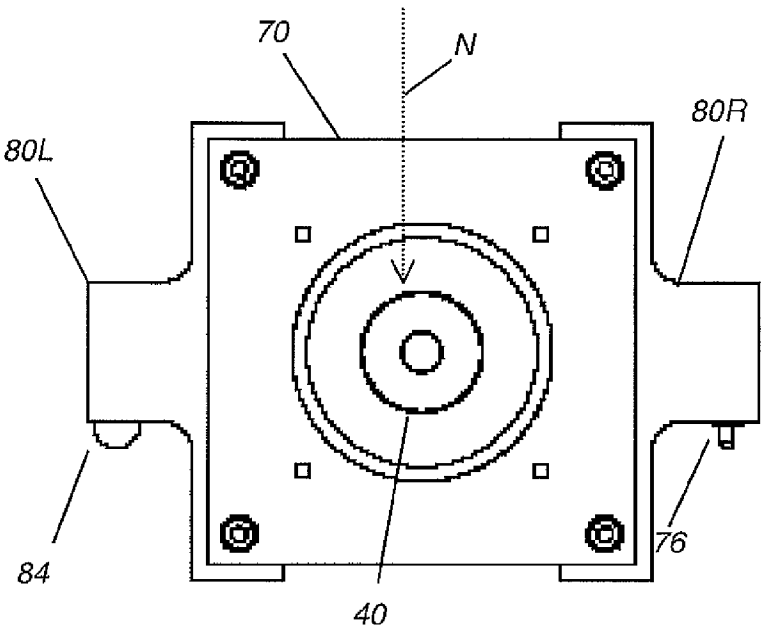
FIGS. 13A and 13B are side and front views, respectively, of drive components in one embodiment; and, FIGS. 14A and 14B are side and front views, respectively, of drive components in an alternate embodiment.
Figure 13A:
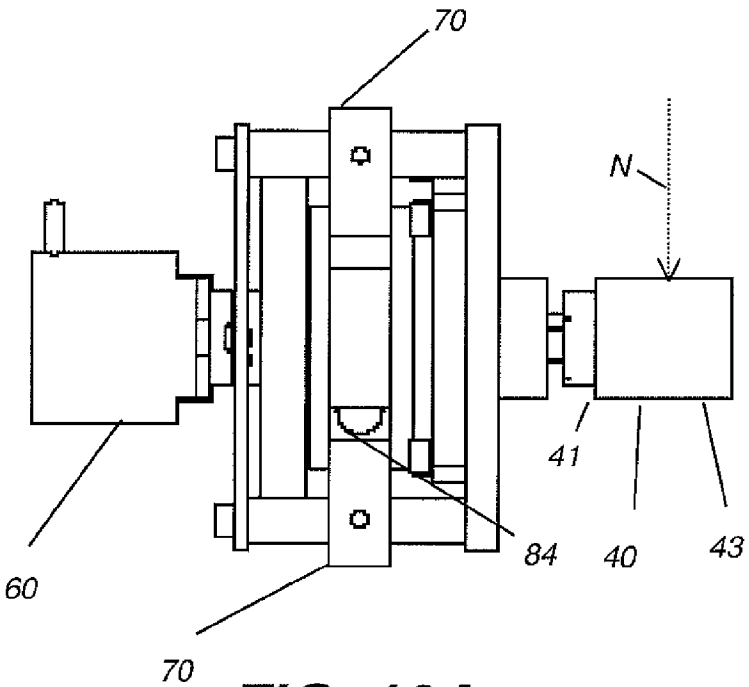

As is shown in FIG. 4A, pinion roller 40 nests between speed reduction wheels 42 and 44 in one embodiment. Alternately, pinion roller 40 may nest against some other portion of entrance and exit drive rollers 16 and 26. In order to drive entrance and exit drive rollers 16 and 26, a nesting force is applied by some type of loading mechanism as a loading force to press pinion roller 40 into position. FIGS. 13A and 13B show the general direction of the nesting force N on pinion roller 40. One goal of the loading mechanism is to apply nesting force N evenly, so that the full contact surface of pinion roller 40 applies substantially equal pressure at all points of contact against speed reduction wheels 42 and 44. With reference to FIG. 13A, for example, this means that the effective nesting force applied at a contact point 41 is the same as the effective nesting force applied at a contact point 43.

Figure 8:
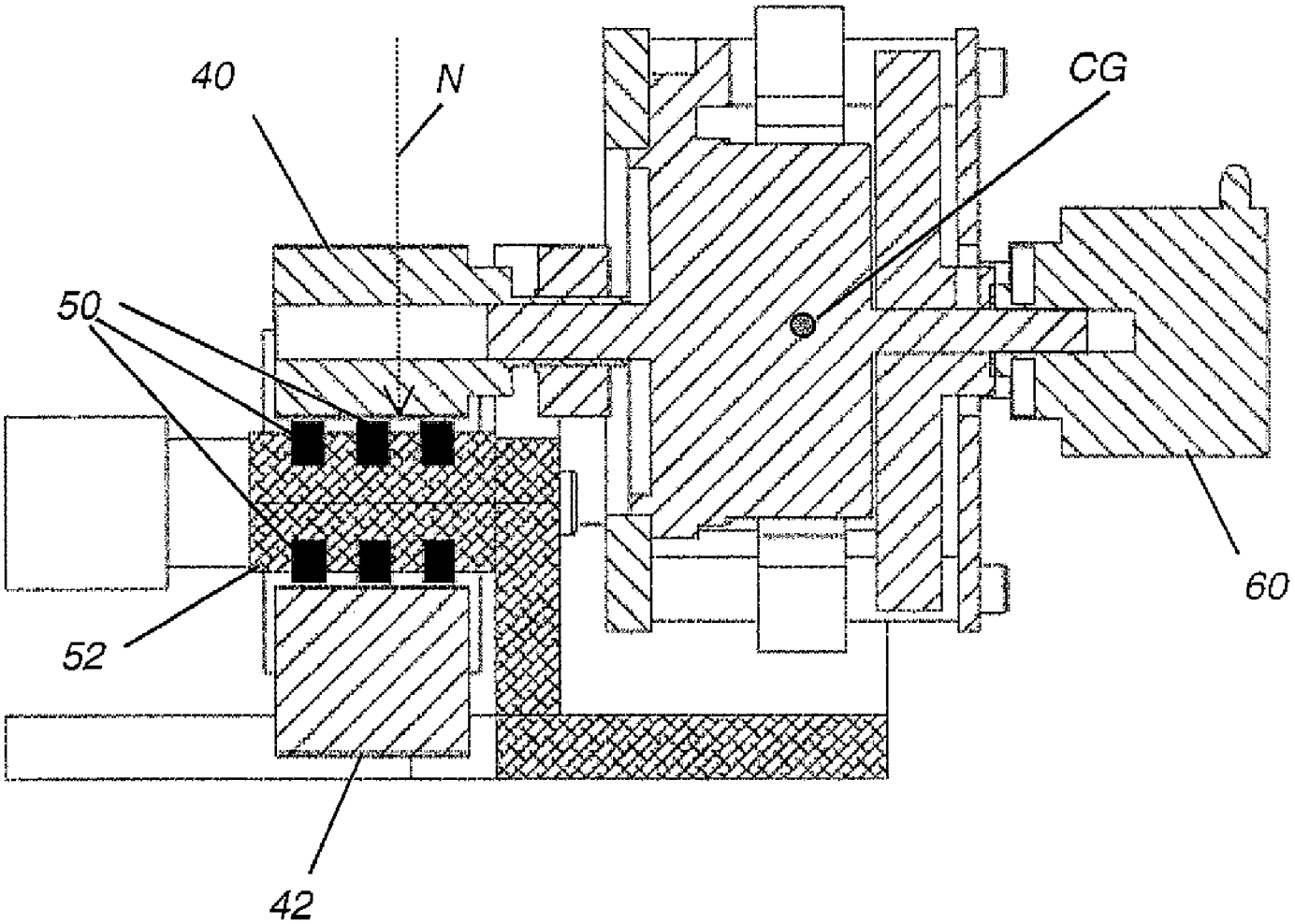
FIG. 8 is a cutaway side view showing drive components of the dual nip media transport.
Figure 9:
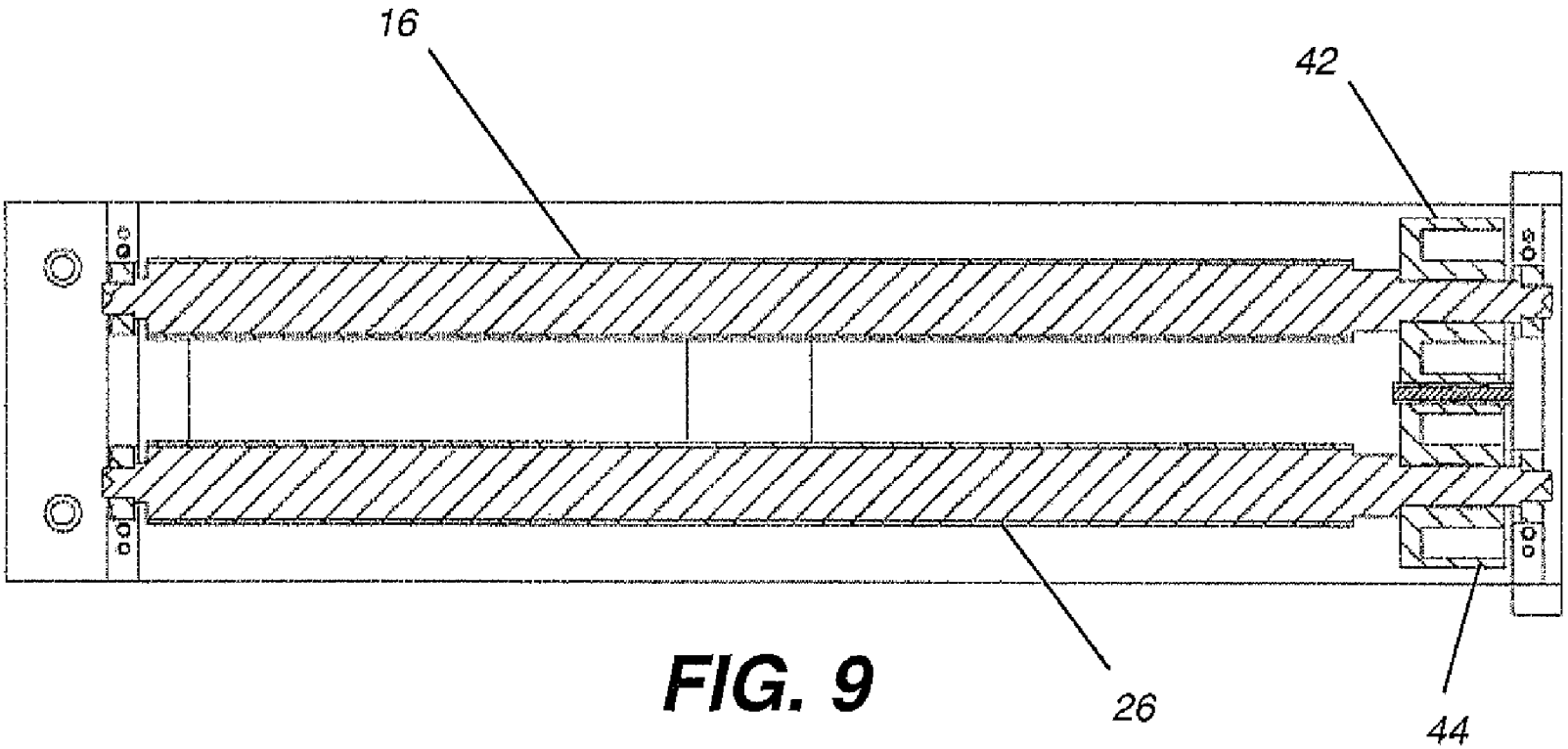
FIG. 9 is a cutaway top view showing dual nip media transport components.

In the embodiment of FIG. 8, nesting force N is applied directly to pinion roller 40 using an arrangement of magnets 50 as a loading mechanism. Magnetic attraction pulls pinion roller 40 into its nesting position and maintains pinion roller 40 in continuous contact for driving entrance and exit drive rollers 16 and 26. The use of magnets 50 as a loading mechanism is particularly advantaged for providing an even amount of pressure along the areas of contact, allowing nesting force N to be applied directly to the body of pinion roller 40.

Figure 14B:
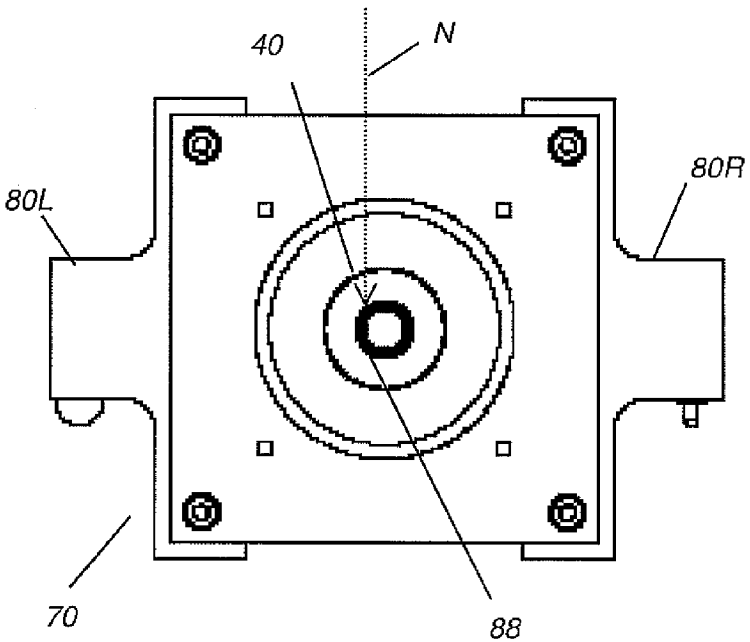
Figure 14A:
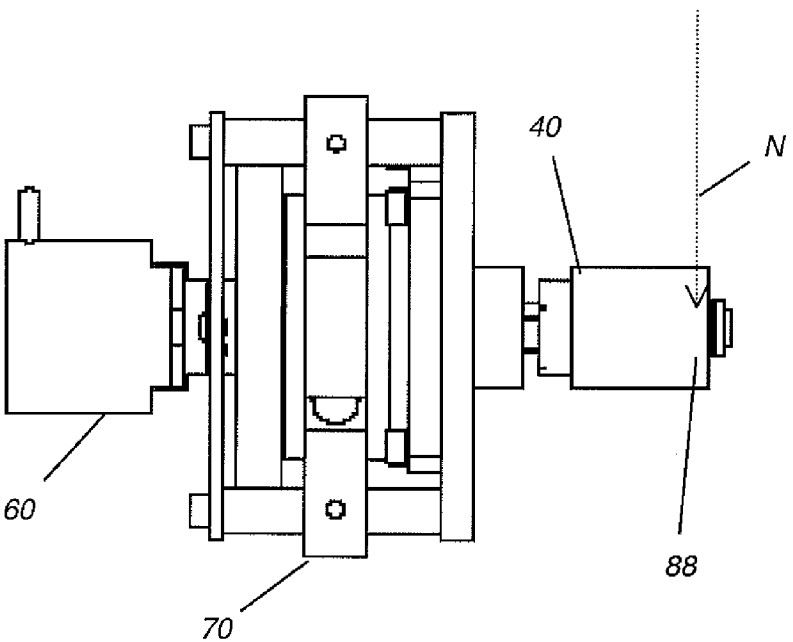

FIGS. 14A and 14B show side and front views, respectively, of an alternative approach for applying nesting force N. Here, a bearing 88 is used, providing a surface for application of force using a spring apparatus of some kind (not shown) as the loading mechanism. Those skilled in the mechanical design arts will readily recognize that deployment of a spring as a loading mechanism requires additional mounting hardware and may require means for adjustment and/or replacement. However, there may be applications for which use of a spring is an advantageous alternative.

Using the two-point balance arrangement of mounting bracket 70 within base 72, as described hereinabove, simplifies the design task of selecting appropriate magnets 50 or spring components. By balancing bracket 70 with respect to the center of gravity CG of motor pinion assembly 82, substantially all of the nesting force applied to pinion roller 40 is, in turn, applied to speed reduction wheels 42 and 44.

The arrangement of motor pinion assembly 82 described with reference to FIGS. 4A through 14B provides two key functions: maintaining pinion roller 40 in continuous contact for driving speed reduction wheels 42 and 44 of entrance and exit drive rollers 16 and 26 and preventing x-axis (R-axis) rotation of the housing of motor 60.

There are a number of options for providing one more magnet 50. One or more stationary magnets 50 can be installed along or within a holder such as a bar 52 (FIG. 8) to attract pinion roller 40. Alternately, pinion roller 40 could itself be magnetized and attracted toward bar 52, where bar 52 is made of a ferromagnetic material, to produce the same effect. Magnets 50 could be replaceable magnets, for example. Possible types of magnet 50 include Alnico, Samarium cobalt, Neodymium Iron Boron, or ceramic, for example. In another embodiment, magnets 50 can be electromagnets. This arrangement would allow printer control logic (from control logic processor 62 in FIG. 2) to apply nesting force to pinion roller 40 only when needed.

Providing Additional Coupling Stiffness

The present invention provides a further refinement to the use of pinion roller 40 whereby additional coupling stiffness and reduced flutter are achieved. Even though recording medium 12 is transported in a single direction, providing coupling stiffness in both directions is be advantageous. That is, there is quantifiable improvement of movement uniformity and reduction of flutter when coupling stiffness is provided in both forward and reverse directions. A belt could be provided to increase coupling stiffness between entrance and exit drive rollers 16 and 26. Alternately, counter roller 46, shown particularly in FIGS. 4A, 4B, and 7, can be provided for this reason.

Figure 7:
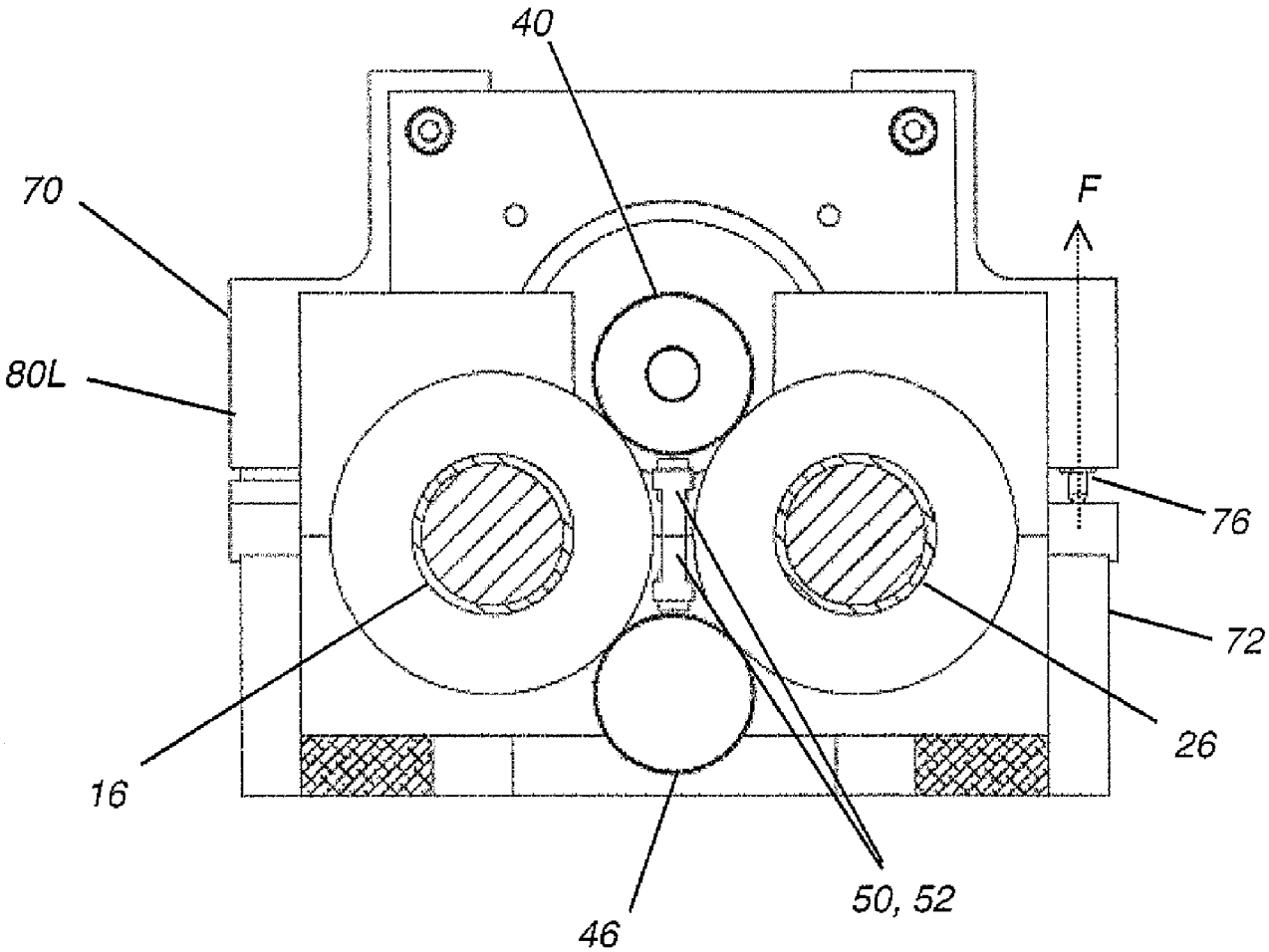
FIG. 7 is a cutaway end view showing drive components of the dual nip media transport.

Some type of loading force is required for counter roller 46. In the embodiment of FIG. 7, counter roller 46 is nested into position using magnetic attraction, in a manner similar to the attraction of pinion roller 40. Otherwise, springs, bearings, and other supporting mechanical components would be necessary to provide a loading force to seat counter roller 46 properly into position against at least some portions of speed reduction wheels 42 and 44 or entrance and exit drive rollers 16 and 26.

The invention has been described in detail with particular reference to certain preferred embodiments thereof, but it will be understood that variations and modifications can be effected within the scope of the invention as described above, and as noted in the appended claims, by a person of ordinary skill in the art without departing from the scope of the invention. For example, the use of speed reduction wheels 42 and 44 as enlarged portions of entrance and exit drive rollers 16 and 26, although advantageous for allowing highs motor speeds and improved torque, is optional for the present invention. In another embodiment, pinion roller 40 is nested directly against the main body of entrance and exit drive rollers 16 and 26. Rollers themselves could be formed from a number of materials, suitably selected according to roller function. In one embodiment, for example, drive rollers 16 and 26 are urethane-coated rollers. A combination of spring force and magnetic or electromagnetic attraction could be used to nest pinion roller 40 into position. Multiple counter rollers 46 or a segmented counter roller 46 could be used. One or more rollers could be hollow, particularly where magnetic attraction is used for nesting.

Various types of printhead 56 could be employed, such as using lasers, LEDs, or other light sources, wherein the light emitted may be outside the visible spectrum. Other types of printhead, utilizing thermal or inkjet printing mechanisms, could be used. Sheet medium 12 could be a photosensitive medium or some other type of recording medium. Either entrance drive roller 16 or exit drive roller 26 could serve as the driving roller in an embodiment.

Thus, what is provided is an apparatus and method for an image recording apparatus with a precision media transport apparatus that uses a dual nip system having precision drive roller motion provided using a pinion roller.

PARTS LIST

10 dual nip transport apparatus
12 recording medium
14 entrance nip
16 entrance drive roller
18 pressure roller
20 imaging area
22 belt
24 exit nip
26 exit drive roller
28 pressure roller
30 dual nip transport apparatus
32 leading edge
34 trailing edge
40 pinion roller
41 contact point
42 speed reduction wheels
43 contact point
44 speed reduction wheels
46 counter roller
50 magnet
52 bar
56 printhead
58 image recording apparatus
60 motor
62 control logic processor
70 bracket
72 base
74 contact surface
76 spring
78 seat
80L left arm
80R right arm
82 motor pinion assembly
84 constraining member
86 encoder
88 bearing
90 Vee fitting

The invention claimed is:

1. An apparatus for recording an image onto a sheet medium, comprising:

a) an entrance drive roller paired with a corresponding entrance pressure roller to form an entrance nip for transporting the sheet medium into an image recording section;

b) the image recording section comprising a write head for recording onto a portion of the sheet medium being transported between the entrance nip and an exit nip;

c) the exit nip formed by an exit drive roller paired with a corresponding exit pressure roller, for transporting the sheet medium out from the image recording section;

d) a motor for providing rotary motion to a pinion roller, the pinion roller mechanically coupled to the entrance and exit drive rollers; and e) a magnetic loading mechanism providing a loading force to nest the pinion roller into rotational contact against a portion of the entrance and exit drive rollers;

wherein said drive rollers contacting said sheet media are not magnetized.

2. An apparatus according to claim 1 wherein the loading mechanism comprises a stationary magnetic assembly magnetically coupled to said pinion roller.

3. An apparatus according to claim 2 wherein said stationary magnetic assembly is a permanent magnet assembly.

4. An apparatus according to claim 2 wherein said stationary magnetic assembly is an electromagnetic assembly.

5. An apparatus according to claim 1 wherein the write head comprises a light source.

6. An apparatus according to claim 1 wherein the write head comprises a laser.

7. An apparatus according to claim 1 further comprising a belt coupling the exit drive roller with the entrance drive roller.

8. An apparatus according to claim 1 further comprising a counter roller coupling the exit drive roller with the entrance drive roller.

9. An apparatus according to claim 8 wherein the counter roller is subject to a magnetic counter roller loading force.

10. An apparatus according to claim 9 wherein the magnetic counter roller loading force is provided by a permanent magnet.

11. An apparatus according to claim 1 wherein the exit drive roller comprises a speed reduction component.

12. An apparatus according to claim 1 wherein the entrance drive roller comprises a speed reduction component.

13. An apparatus for recording an image onto a sheet medium, comprising:

a) an entrance drive roller paired with a corresponding entrance pressure roller to form an entrance nip for transporting the sheet medium into an image recording section;

b) the image recording section comprising a write head for recording onto a portion of the sheet medium being transported between the entrance nip and an exit nip;

c) the exit nip formed by an exit drive roller paired with a corresponding exit pressure roller, for transporting the sheet medium out from the image recording section;

d) a motor for providing rotary motion to a pinion roller, the pinion roller mechanically coupled to the entrance and exit drive rollers;

e) a loading mechanism providing a loading force to nest the pinion roller into rotational contact against a portion of the entrance and exit drive rollers; and further comprising a motor pinion assembly for constraining the motor with respect to its rotational axis, the motor pinion assembly comprising:

f) a bracket coupled to the motor, comprising (i) a first arm extending away from the rotational axis in a first direction;

(ii) a second arm extending away from the rotational axis in a second direction, opposite the first direction with respect to the rotational axis of the motor;

g) a base for seating the bracket along its first and second arms, comprising:

(i) a first seat for supporting the first arm of the bracket at a constraining member, supporting a portion of the motor weight thereby; and (ii) a second seat for supporting the second arm of the bracket at a counter force providing element, and the counter force providing element thereby supporting the remaining portion of the motor weight.

14. An apparatus according to claim 13 wherein the center of gravity of the assembled motor pinion assembly, the first seat, and the second seat are substantially within a common plane, wherein the common plane is substantially orthogonal to the axis of rotation of the motor.

15. An apparatus for recording an image onto a sheet medium, comprising:

a) an entrance drive roller paired with a corresponding entrance pressure roller to form an entrance nip for transporting the sheet medium into an image recording section;

b) the image recording section comprising a write head for recording onto a portion of the sheet medium being transported between the entrance nip and an exit nip;

c) the exit nip formed by an exit drive roller paired with a corresponding exit pressure roller, for transporting the sheet medium out from the image recording section;

d) a motor for providing rotary motion to a pinion roller, the pinion roller mechanically coupled to the entrance and exit drive rollers; and e) a magnetic loading element providing a loading force to nest the pinion roller into rotational contact against a portion of the entrance and exit drive rollers;

wherein said pinion roller is magnetized and said magnetic loading element includes a stationary ferromagnetic bar, magnetically coupled to said magnetized pinion roller; and wherein said drive rollers contacting said sheet media are not magnetized.

* * * * *